US005099787A

United States Patent [19]

Powers

[11] Patent Number: 5,099,787

[45] Date of Patent: Mar. 31, 1992

[54] GROUNDING APPARATUS

[75] Inventor: Harold R. Powers, St. John, Ind.

[73] Assignee: The Sherwin-Williams Company, Cleveland, Ohio

[21] Appl. No.: 476,917

[22] Filed: Feb. 7, 1990

[51] Int. Cl.[5] ..... B05C 11/00

[52] U.S. Cl. ..... 118/635; 118/500; 118/630

[58] Field of Search ..... 118/500, 503, 630, 635, 118/682

[56] References Cited

U.S. PATENT DOCUMENTS 2,553,724 5/1951 Ransburg ..... 118/635
3,937,180 2/1976 Wiggins ..... 118/635

OTHER PUBLICATIONS

Coating News, Sherwin-Williams, 1987, pp. 9-11.
Ransburg Gema Safety Bulletin entitled Target Grounding.

*Primary Examiner*—David A. Simmons
*Assistant Examiner*—Robert Barker
*Attorney, Agent, or Firm*—Steven W. Tan; Robert E. McDonald; Jeanne E. Longmuir

[57] ABSTRACT

A grounding apparatus for supporting an article during manufacture, preferably including a trolley, a hanger assembly and a hook assembly. The trolley is moveable along, and electrically connected to, a conveyor track for transporting the articles. The hook assembly supports the article and comprises an electrically conductive, rotatable, hook and base. The hanger assembly is electrically conductive and secures the hook assembly to the trolley. The hook assembly includes a rotatable hook and base having an electrically conductive brush fixedly attached to the base and contacting the rotating hook and base to electrically connect the hook with the base, and define an electrically conductive path between the article and the trolley.

9 Claims, 4 Drawing Sheets

GROUNDING APPARATUS

FIELD OF INVENTION

The present invention relates to an apparatus for maintaining a conductive path between an article to be painted and a grounded support structure during an electrostatic paint finishing process, and specifically relates to an apparatus for maintaining a grounded path from an article to be painted, through a trolley, a hanger assembly and a hook assembly, to a conveyor track supporting the system.

BACKGROUND OF THE INVENTION

During an electrostatic paint finishing process, a grounded path must be maintained between an article to be painted and the structure supporting the article to be painted. The grounded path is provided for safety purposes, and to ensure the efficient application of the paint. Unless a grounded connection is maintained during the paint finishing process, static charge can build up on the article and arc to a nearby object. Such arcing can create the possibility of an explosion or fire. Accordingly, maintaining the article with a proper ground connection is important in order to reduce the possibility of static charge arcing to other objects.

During the paint finishing process, dirt, chemicals and paint overspray tend to build up on the support structure and increase the electrical resistance between the article and the support structure. The movable parts of the support structure are the most susceptible to this accumulation, and consequently, tend toward increased electrical resistance and a decrease in the efficiency of the paint application process. Conventional cleaning of the support structure using solvents and thinners has not been found to maintain a proper ground between the article and the support structure. Additionally, such conventional cleaning may not sufficiently clean the parts, and can also be inconvenient, costly and time consuming.

In the past, various devices have been used to maintain a conductive path between the article and support structure during the paint finishing process. In these devices, a conventional clevis pin is suspended from a hanger. The knife action between the sharp edge of the swinging clevis pin and the hanger cuts through accumulated paint to maintain an electrical path with the article to be painted. Such prior art devices, however, do not always maintain a conductive path between the article and pin, the pin and hanger, and the hanger and the remainder of the support structure, particularly between those parts which are movable with respect to one another. Further, due to the accumulation of dirt, chemicals and paint overspray, such prior art devices may not maintain a low electrical resistance, preferably a resistance of less than approximately 1 Ohm.

SUMMARY OF THE INVENTION

The present invention provides a hook assembly for supporting an article to be painted during an electrostatic paint finishing process which maintains an electrically conductive path between the article and its support structure. The electrically conductive path allows for a high degree of transfer efficiency between the paint and the article. A greater transfer efficiency enables less paint waste due to overspray, and thus, a reduction of volatile organic contaminants released into the environment.

The support structure preferably comprises a trolley assembly which is movably supported along a track. The track extends substantially the length of a paint application area where the electrostatic paint finishing process is performed. During painting, the article is supported on the trolley and may be rotated through any selected angle without degradation of the conductive path between the article and the trolley.

In a preferred embodiment, the trolley assembly includes an arm member having roller assemblies mounted thereon. The roller assemblies engage the track for moving and supporting the trolley along the track. The support structure further includes a hanger assembly which connects the trolley to the hook assembly. The hook assembly is movably suspended from the hanger assembly of the trolley.

The hook assembly includes a base and a rotatable hook. A fixed, electrically-conductive brush is additionally included, which is supported on a top surface of the hook. The hook supports the article to be painted, and is secured to the base. The top surface of the hook is substantially flat, and positioned to enable continuous contact with the brush during rotation of the hook. The brush is supported in engagement with the hook on the base.

The trolley assembly, hanger assembly and hook assembly are composed of electrically conductive materials, and form an electrically conductive path between the trolley assembly, hook assembly and the article to be painted. When the article is supported on the trolley and moved along the conveyor system track into the paint finishing area, a low-resistance, conductive path is maintained between the article to be painted and the trolley assembly.

The present invention thus provides a hook assembly with a rotatable hook, a base and an electrically conductive brush. The hook assembly supports an article to be painted, and, together with a hanger assembly and a support structure which is preferably a trolley assembly, the assemblies provide an electrically conductive path to the article. During the electrostatic paint finishing process, the hook assembly enables the conductive path to be maintained with the article during movement of the hook through a 360° rotation.

These features, as well as additional features and advantages of the present invention, will be better understood from the following detailed description and attached drawings setting forth in detail certain embodiments of the invention which are only a few of the various embodiments of the principles of the invention.

DESCRIPTION OF THE PREFERRED EMBODIMENT

Figure 1:
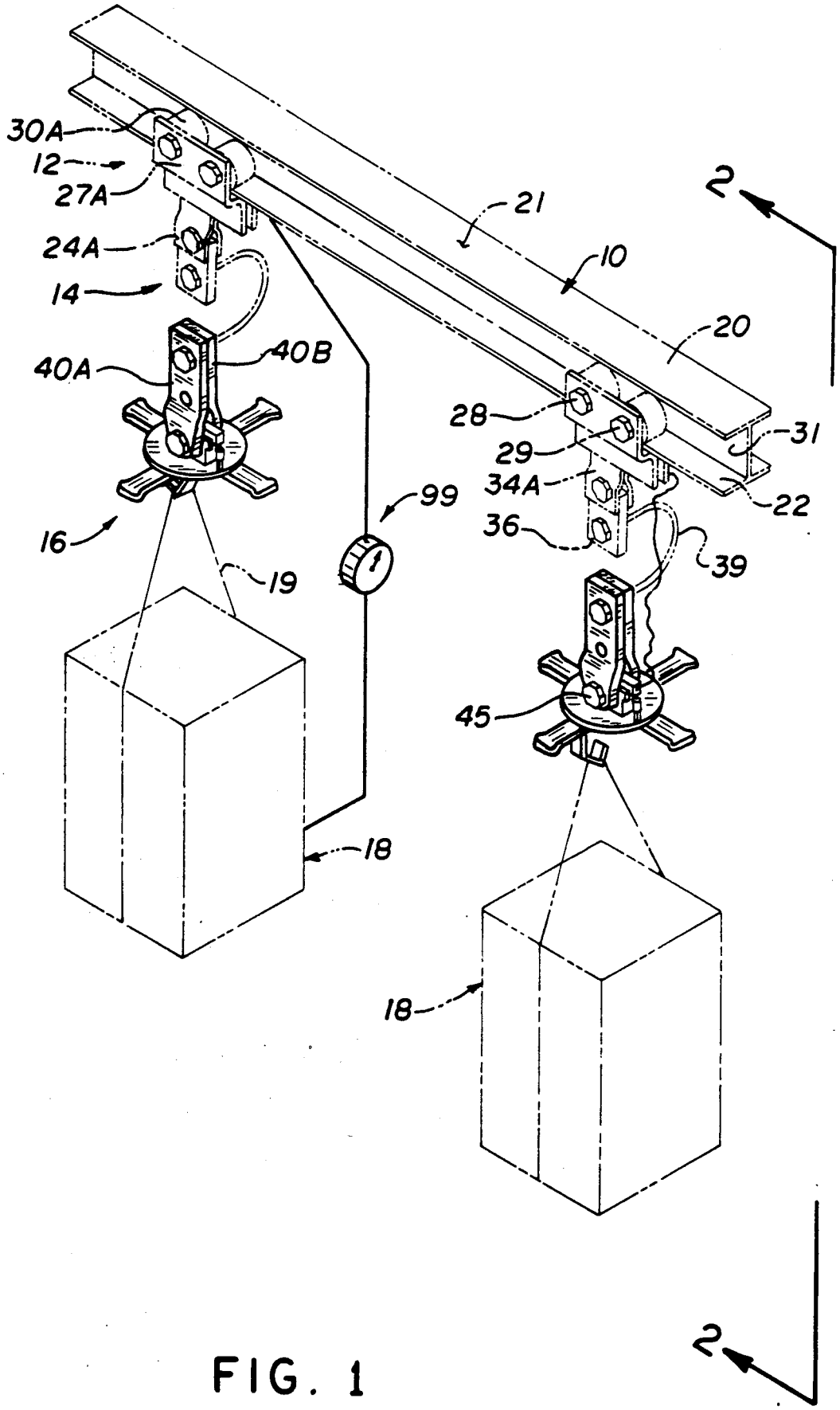
FIG. 1 is a schematic perspective view of components of the finishing system using the hook assembly of the present invention.

Turning now in more detail to the drawings, and initially to FIG. 1, a preferred finishing system using the hook assembly device of the present invention includes a track indicated generally at 10, a trolley assembly, indicated generally at 12, a hanger assembly, indicated generally at 14, and the hook assembly, indicated generally at 16. An article 18 being electrostatically painted during the process is supported from the hook assembly 16 by an electrically conductive sling or the like 19. It is noted that the articles may also be supported directly on the hook assembly if desired. Each of these major components will be discussed below, followed by a brief description of the operation of the composite finishing system using the grounding apparatus of the hook assembly.

Track

As shown, the track 10 comprises an I-beam 20, which extends for the full length of the electrostatic paint process line, and forms part of the conventional conveyor system. The I-beam includes a top flange 21, bottom flange 22 and an intermediate vertical web 31. The top flange 21 of I-beam 20 is normally grounded to, secured to and supported from the ceiling or framework of the building. The bottom flange 22 of the I-beam 20 supports the trolley assembly 12 for rolling movement therealong. While an I-beam track is shown as the preferred embodiment, it will be appreciated that other track or conveyor systems could be used to support and/or drive the trolley assembly 12 along the paint process line.

Trolley Assembly

Figure 2:
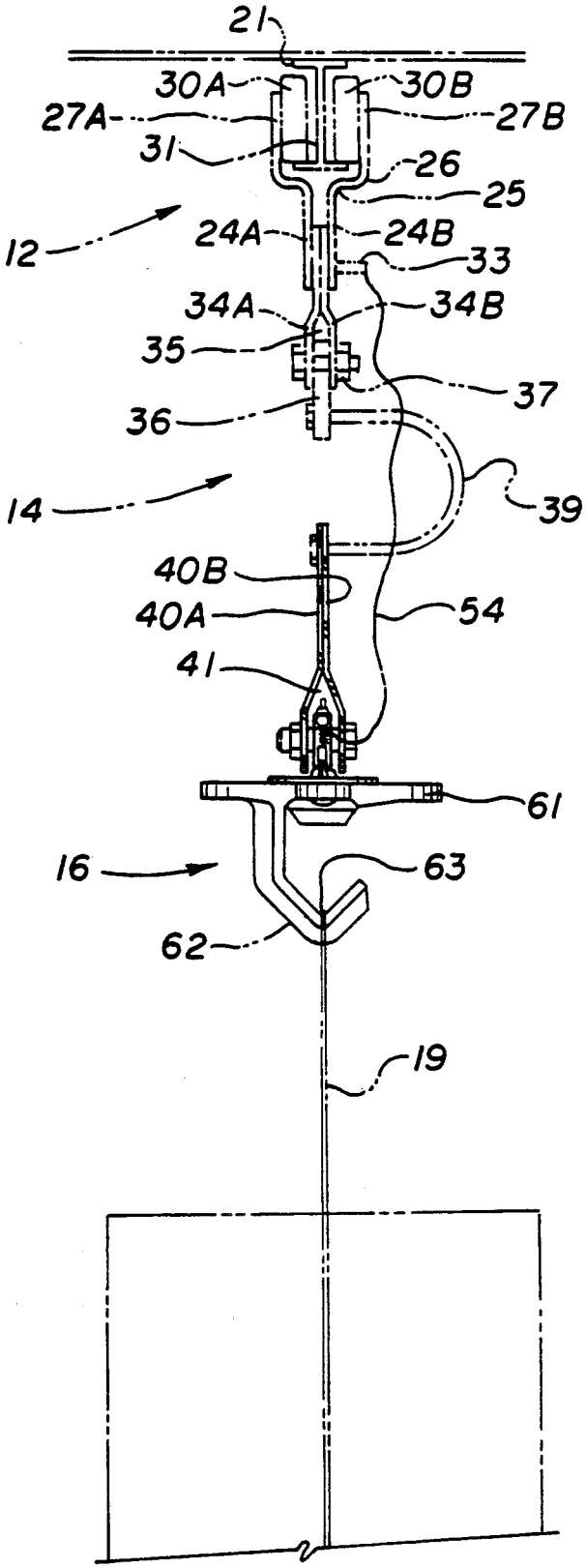
FIG. 2 is an end view of the components of the finishing system using the hook assembly of the present invention, and taken generally along the plane 2—2 of FIG. 1.

As shown in FIG. 2, the trolley assembly 12 includes two interconnected trolley arms 24A and 24B. The upper ends of trolley arms 24A and 24B are oppositely, outwardly and upwardly bent at 25 and 26, respectively, to form opposed, vertically extending wheel assembly attachment portions 27A and 27B. Two spaced horizontally extending shafts 28 and 29 are mounted to portion 27A, and two spaced, horizontally extending shafts (not shown) are mounted to portion 27B. A pair of spaced rollers is rotatably mounted to each of these pairs of spaced shafts, resulting in a pair of rollers 30A on one side of the vertical web 31 of I beam 20 and another pair of rollers 30B on the other side of web 31. These opposed pairs of rollers 30A and 30B roll along the upper surface of lower flange 22 and rectilinearly guide the trolley assembly in its trowel along the I-beam 20. It should be noted that the rollers may be supported on arms and shafts of various designs, such as a one-piece fork-like member with a pin extending therethrough.

The bottom end of trolley arms 24A, 24B are aligned, and have a first or upper terminal pin 33 mounted thereon and extending outwardly therefrom. The spaced bottom ends of trolley arms 24A and 24B receive therebetween the upper end of the hanger assembly 14.

Hanger Assembly

The hanger assembly 14 at its upper end, includes two interconnected hanger arms, 34A and 34B. The upper ends of the hanger arms are received between, and connected to, the lower ends of trolley arms 24A and 24B. The lower ends of hanger arms 34A and 34B form a clevis 35, which receives a hanger plate 36. The upper end of plate 36 is secured to clevis 35 by a fastener 37, which may be used to provide a pivotal connection therebetween, to provide limited swinging movement for the hanger assembly if required by the process line.

The lower end of hanger plate 36 may have an upper arm of a C-shape connector 39 secured thereto. The connector may be of any conventional shape or variety, such as spring biased or a piston connector. In the preferred embodiment, the C-shape connector provides some degree of vertical flexure in the hanger assembly 14 to accommodate different loads or load conditions as may be required by the process line involved. The lower arm of C-shape connector 39 is secured to the upper ends of extension arms 40A and 40B of the hanger assembly 14.

The vertical extension arms 40A and 40B are respectively bent at their bottom ends to cooperatively form a yoke 41. The yoke receives the upper portion of the hook assembly.

Hook Assembly

Figure 3:
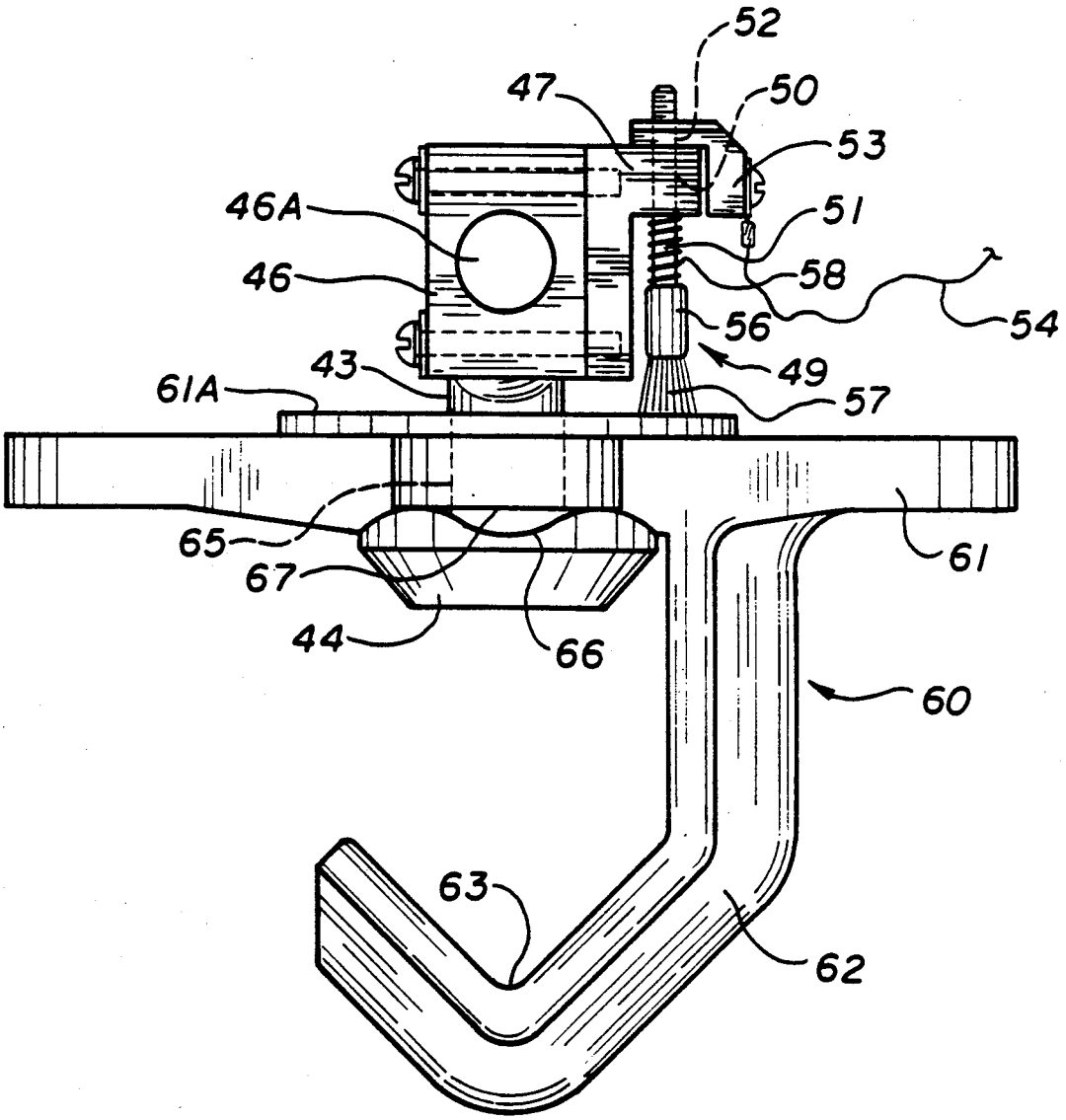
FIG. 3 is an elevation of the hook assembly of the present invention.
Figure 4:
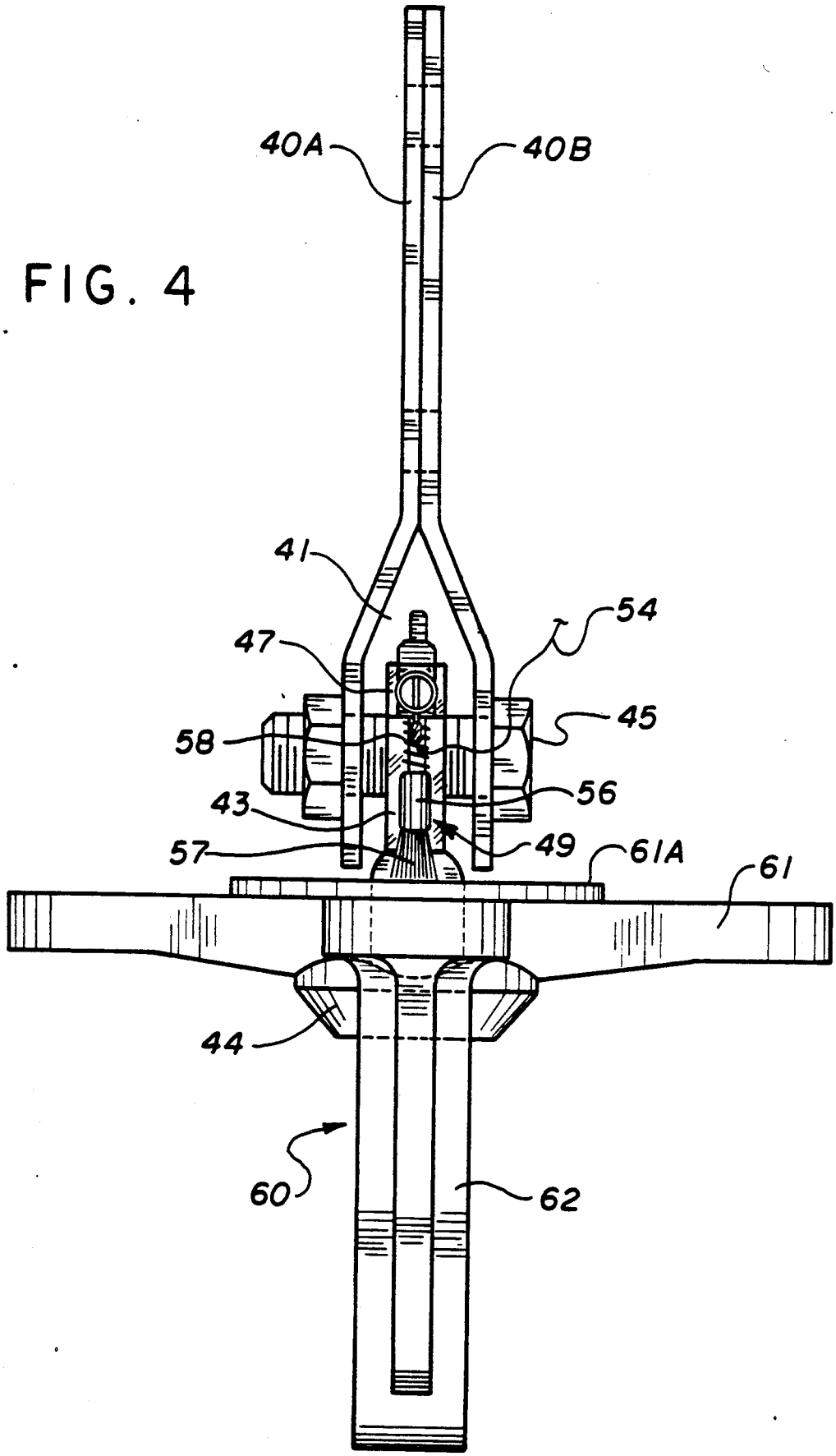
FIG. 4 is an end elevation of the hook assembly and a portion of the hanger assembly showing the hook rotated relative to the hanger assembly as compared to FIG. 2.

As shown in FIG. 3, the hook assembly 16 includes base having a vertical shaft portion 43 and a bottom, supporting head 44 of enlarged diameter. The shaft portion 43 of the base is fixedly secured to yoke 41 by a fastener 45. As best shown in FIG. 3, a housing portion 46, integral with the shaft portion 43, includes an aperture 46A, to secure the base to the yoke by fastener 45. This housing portion 46 includes a horizontal shoulder 47 which has a vertical hole 50 extending therethrough to mount the electric connection brush assembly, indicated generally at 49 in FIGS. 3 and 4. The horizontal shoulder 47 is secured to the housing portion 46 by conventional fasteners 47A, which extend through the housing portion into the shoulder, as shown in FIG. 3.

The electrical connection brush assembly includes a vertical rod 51 extending therethrough and therebelow. The upper end of rod 51 above shoulder 47 is frictionally received in, and slidingly engages, a hole 52 in a terminal block 53, which forms a second or lower terminal. The bottom end of an electrical conductor 54 is physically mounted on, and in electrical conductance with the terminal block 53. The other or upper end of electrical conductor 54 is secured to, and in electrical conductance, with the upper terminal pin 33 on trolley 12. This conductor is used to establish an electrical circuit between the trolley and hook assembly.

To this end, the bottom end of rod 51 below shoulder 47 has a brush head 56 of larger diameter mounted on the bottom end thereof. The brush head 56 has a plurality of electrically conductive, for example, metallic bristles secured to the bottom thereof and extending downwardly therefrom to form a brush 57. A compression spring 58 is positioned around rod 51 and extends between the shoulder 47 and brush head 56. Spring 58 normally urges brush head 56 and brush 57 downwardly in engagement with the hook, indicated generally at 60.

The integrally formed hook includes a base 61 and a hook 62. The hook 62 preferably has a J-shape configuration with the bite 63 thereof receiving and supporting the upper end of sling 19. Alternatively, the article to be painted may be received and supported therein. The bite 63 of the hook is generally in vertical alignment with the trolley and hanger assembly to enhance loading and operational characteristics. For this purpose, the vertical portion of hook 62 is connected to the bottom of base 61 off center.

The base 61 has a top surface 61A, with a vertical, central hole 65 extending therethrough. This hole 65 receives the shaft portion 43 of the fixed base. The supporting head 44 of the fixed base underlies and supports the base 61 of hook 60. The base 61 can be rotated relative to the shaft 43, preferably in fixed increments.

For this purpose, the upper surface of supporting head 44 may have a smoothly curved wave configuration as shown at 66. The bottom surface of hook base 61 resting on the upper surface of supporting head 44 may have a complemental smoothly curved wave configuration as indicated at 67. When the surface wave configurations rate as shown in FIG. 3, the hook 60 is temporarily held in a fixed position, relative to the hub body. However, the hook position can be changed at any time by rotating the hook 60 relative to the base. Vertical movement of the hook caused by relative rotation between the respective curved surfaces of the base and supporting head is accommodated by the vertical clearance between the base 61 and housing portion 46 and by vertical movement of the spring biased rod 51. The rotation of hook 60 may incrementally continue until the opposed curved surfaces on the hook and supporting head 44 again mate.

The increments of rotational movement can be varied by selecting wave curves of different frequency. In addition, alternative detent arrangements can be used. However, in all such detent forms, the electrical connection brush assembly is in contact with the hook.

During operation, and best shown in FIG. 3, spring 53 urges brush 57 into engagement at all times with the top surface 61A of hook 60. The brush 57 will be in sweeping contact with the top surface 61A of the hook to provide electrical contact therewith. This sweeping contact allows the hook to be rotated and also cleans or removes deposits from the top surface, to enhance or maintain the electrical contact over a long period of time. This rotation of the hook relative the base and the hanger assembly is illustrated by comparing the position of the hook in FIG. 2 compared to its position in FIG. 4. The contact provided by the brush engaged with the hook throughout 360° of rotation maintains the electrical contact from the article to the trolley assembly and ensures proper grounding of the article being painted. Additionally, the conductivity provided by the present invention between the article to be painted and the structure supporting the article is sufficient to prevent unwanted electrical or static charge build up, and to provide a high degree of efficiency in the transfer of paint to the article being painted.

Operation of the paint finishing process may be accomplished when the resistance between the article and top flange 21 of the conveyor I-beam 20 (or other suitable ground), as shown schematically at the measurement location illustrated generally at reference numeral 99 in FIG. 1, is less than 1 MegaOhm. A conventional high resistance Ohm meter is preferrably used to more reliably measure such resistances.

During operation of the paint finishing process at a high resistance, or zero resistance, for example, where the article to be painted is of a plastic material, the first pass of paint provides the article with a paint coating which reduces and overcomes some of the resistance, since the coating in effect becomes part of the electrical path to the article. During this type of operation, successive passes of paint during the process provide the article with still further paint coatings which may eventually overcome the disadvantages of high initial resistance.

During operation of a paint finishing process where low resistance is possible, and the present invention is used, a resistance of approximately 1 Ohm, and preferably less than 1 Ohm, is preferred in order to obtain the desired efficiency in the transfer of paint during the finishing process. The present invention enables this desired low resistance to be consistently maintained. By consistently maintaining a low resistance, electrostatic charge which may build up during operation of the finishing process is grounded, and thus is not retained on the article to be painted. An additional advantage is also obtained by such discharging of the article, in that there is less dirt and dust particle attraction to the article during operation of the finishing process.

It will be apparent from the foregoing that changes may be made in the details of construction and configuration without departing from the scope and spirit of the invention as defined in the following claims.

I claim:

1. A system for supporting an article during manufacture, comprising:

a support structure, a hanger assembly and a hook assembly, said hook assembly for removably and electrically interconnecting said support structure and hook assembly, said hook assembly comprising a hook, an electrical connector assembly and a base, said hook being electrically connected to said article and rotatably supported by said base, said electrical connector assembly comprising a biasing means and a brush having a shaft and a head with electrically conductive bristle elements extending therefrom, said shaft being slidably engaged with said base and said biasing means engaged between said base and head to bias said bristle elements into engagement with said hook, said electrical connector assembly thereby secured to said base, and electrically interconnecting said base and said hook such that said electrical connector assembly, rotatable hook and base define an electrically conductive path between said article and support structure.

2. The system of claim 1 wherein said system further includes a ground wire connected between said electrical connector assembly and said support structure to ground said article.

3. The system of claim 1 wherein said biasing means comprises a spring.

4. The system of claim 2 wherein said brush and spring are positioned to provide continuous engagement between said bristle elements and said hook during rotation of said hook with respect to said base.

5. A system for supporting an article during electrostatic paint finishing, comprising:

a trolley for transporting an article through a paint application area;

a rotatable hook assembly electrically connected with and mechanically suspended from, said trolley;

said hook assembly comprising an interconnected and electrically conductive hook, base, and connector, wherein said hook is rotatable with respect to said base, and said hook is electrically and mechanically connected to an article; and said electrically conductive connector is fixedly attached to said base, and engaged with said hook by a metal brush element contacting said base to electrically connect said hook and base during rotation therebetween to define an electrically conductive path between an article and said trolley.

6. The system of claim 5 wherein said system further includes a ground wire connected between said base and brush element, and said trolley to ground said article.

7. An electrically conductive support for an article during manufacture, comprising:

a hook assembly electrically connected with the support structure for supporting articles during manufacture, said hook assembly comprising a hook and base which are rotatably interconnected, and an electrically conductive connector secured to said base, said electrically conductive connector comprising a brush including a shaft portion slidably engaged with said base and a bristle portion spring biased into engagement with said hook, said brush in electrical contact with said hook which is adapted to maintain an electrical connection with and electrically interconnect said hook with said base during rotation of said hook to define a continuous electrical path with an article through said base, connector and hook.

8. The support of claim 7 wherein said base is connected with a ground wire connected with a support structure to ground an article supported on said hook.

9. The support of claim 8 wherein said support structure comprises a conveyor system for transporting articles being electrostatically painted during the manufacturing process.

* * * * *